US008960157B2

(12) United States Patent
Kusakabe et al.

(10) Patent No.: US 8,960,157 B2
(45) Date of Patent: Feb. 24, 2015

(54) DRIVE DEVICE FOR ELECTROMAGNETIC FUEL INJECTION VALVE

(75) Inventors: Ryo Kusakabe, Hitachinaka (JP); Motoyuki Abe, Mito (JP); Hideharu Ehara, Yokohama (JP); Tohru Ishikawa, Kitaibaraki (JP); Noriyuki Maekawa, Kashiwa (JP); Takuya Mayuzumi, Hitachinaka (JP)

(73) Assignee: Hitachi Automotive Systems, Ltd., Hitachinaka-shi (JP)

( * ) Notice: Subject to any disclaimer, the term of this patent is extended or adjusted under 35 U.S.C. 154(b) by 417 days.

(21) Appl. No.: 13/403,506

(22) Filed: Feb. 23, 2012

(65) Prior Publication Data

US 2012/0216783 A1 Aug. 30, 2012

(30) Foreign Application Priority Data

Feb. 25, 2011 (JP) ..... 2011-039180

(51) Int. Cl.

| | |
|---|---|
| ***F02D 41/02*** | (2006.01) |
| ***F02M 51/06*** | (2006.01) |
| ***F02D 41/20*** | (2006.01) |
| *F02D 41/40* | (2006.01) |

(52) U.S. Cl.

CPC ..... *F02D 41/20* (2013.01); *F02D 41/402* (2013.01); *F02D 2041/2037* (2013.01)

USPC ..... 123/490; 123/472; 239/585.1

(58) Field of Classification Search

CPC ..... F02D 41/20; F02D 41/2096; F02D 41/30; F02D 41/3094; F02M 47/027; F02M 51/061; F02M 51/0685

USPC ..... 123/299, 472, 478–480, 490; 239/585.1–585.5, 900; 335/220, 279, 335/281; 701/103, 104

See application file for complete search history.

(56) References Cited

U.S. PATENT DOCUMENTS

| | | | | |
|---|---|---|---|---|
| 4,180,026 | A * | 12/1979 | Schulzke et al. | 123/490 |
| 5,865,371 | A | 2/1999 | Pace et al. | |
| 5,941,216 | A * | 8/1999 | Arakawa | 123/490 |

(Continued)

FOREIGN PATENT DOCUMENTS

| | | |
|---|---|---|
| EP | 0 727 566 A2 | 8/1996 |
| EP | 1 909 009 A2 | 4/2008 |

(Continued)

OTHER PUBLICATIONS

Japanese-language Office Action dated Apr. 24, 2013 with partial English translation (Four (4) pages).

(Continued)

*Primary Examiner* — John Kwon
*Assistant Examiner* — Johnny H Hoang
(74) *Attorney, Agent, or Firm* — Crowell & Moring LLP

(57) ABSTRACT

The drive device is configured to, during a time interval between an earlier fuel injection (first fuel injection) and a later fuel injection (second fuel injection), supply an electromagnetic coil with an intermediate current at a voltage with a level of not opening the valve. Further, the drive device sets a voltage application for supplying the intermediate current to initiate before a valve closing in the earlier fuel injection and terminate before half a period of time between a first instant when the valve is closed in the earlier fuel injection and a second instant when a supply of a drive current for opening the valve is initiated in the later fuel injection.

20 Claims, 8 Drawing Sheets

(56) References Cited

U.S. PATENT DOCUMENTS

| | | | | |
|---|---|---|---|---|
| 6,123,058 | A * | 9/2000 | Endou | 123/490 |
| 6,330,873 | B1 * | 12/2001 | Letang et al. | 123/322 |
| 6,705,277 | B1 * | 3/2004 | McGee | 123/299 |
| 6,832,601 | B2 * | 12/2004 | Watanabe et al. | 123/490 |
| 7,273,038 | B2 * | 9/2007 | Hayakawa | 123/478 |
| 7,774,126 | B2 * | 8/2010 | Abe et al. | 701/104 |
| 2002/0056443 | A1 * | 5/2002 | Yamakado et al. | 123/490 |
| 2003/0089333 | A1 * | 5/2003 | Duffy et al. | 123/299 |
| 2003/0140898 | A1 * | 7/2003 | Xu | 123/490 |
| 2004/0159716 | A1 * | 8/2004 | Azam et al. | 239/5 |
| 2005/0126534 | A1 * | 6/2005 | Kikutani | 123/299 |
| 2008/0276907 | A1 | 11/2008 | Abe et al. | |
| 2008/0289607 | A1 | 11/2008 | Mayuzumi et al. | |

FOREIGN PATENT DOCUMENTS

| | | | |
|---|---|---|---|
| EP | 1 990 526 | A2 | 11/2008 |
| JP | 2002-115591 | A | 4/2002 |
| JP | 2002-514281 | A | 5/2002 |
| JP | 2002-364768 | A | 12/2002 |
| JP | 2003-120848 | A | 4/2003 |
| JP | 2008-169762 | A | 7/2008 |
| JP | 2008-280876 | A | 11/2008 |

OTHER PUBLICATIONS

European Search Report dated Jun. 8, 2012 (five (5) pages).

* cited by examiner

DRIVE DEVICE FOR ELECTROMAGNETIC FUEL INJECTION VALVE

CLAIM OF PRIORITY

The present application claims priority from Japanese application serial no. 2011-39180, filed on Feb. 25, 2011, the contents of which are hereby incorporated by references into this application.

FIELD OF THE INVENTION

The present invention relates to a drive device for an electromagnetic fuel injection valve used, for instance, for an internal combustion engine.

BACKGROUND OF THE INVENTION

A normally-closed electromagnetic fuel injection valve is provided with a pressure member such as a spring whose force is applied to a movable core including a valve plug in a valve closing direction. An actuator of the electromagnetic fuel injection valve includes an electromagnetic coil, a stationary core, and the movable core, and upon a current being supplied to the electromagnetic coil, an attractive force is generated between the stationary core and the movable core. By the attractive force exceeding a force of the pressure member exerting in the valve closing direction, the valve plug leaves from a valve seat to make a valve opening. When the current supplied to the electromagnetic coil is subsequently shut off, the attractive force between the stationary core and the movable core is set free. Thereby, the injection valve is closed by force of the pressure.

As a prior art related to the above-mentioned electromagnetic fuel injection valve, JP 2002-115591A discloses a method of controlling the valve closing speed of the movable core by supplying the current to the electromagnetic coil again just after once having shut off the current for the electromagnetic coil. This method can reduce an impact force of the valve plug against the valve seat at the time when the valve plug sits on the valve seat to close the valve, and thereby reduce bound of the valve plug due to impact on the valve seat.

JP2008-280876A discloses a method of, when a valve operation is done from a valve open state to a valve closed state, retuning the valve plug quickly to its initial position of the beginning of a valve opening operation, by energizing the electromagnetic coil just after the valve plug sat on the valve seat with a bound on impact. That is, thereby, the valve plug is applied with a force through the movable core in a direction opposite to the valve closing direction, so a rebound motion of the valve plug is suppressed just after the valve plug sat on the valve seat. This enables the valve plug to quickly return to its initial position of the beginning of the valve opening operation.

AS a recent prior art of reducing fuel consumption of an internal combustion engine, for example, a downsizing-engine is proposed. The downsizing-engine is configured to reduce exhaust emissions for downsizing purposes while acquiring an adequate output with a supercharger. According to the downsizing-engine, it can since reduce exhaust emissions, it also can reduce fuel pumping loss and pumping mechanical friction resulting in reduction of fuel consumption. Meanwhile, the use of the supercharger makes it possible to acquire an adequate output. In addition, a direct injection method is used to produce an intake air cooling effect. This makes it possible to suppress a compression ratio decrease caused by supercharging and achieve low fuel cost. As the downsizing-engine tends to decrease a cylinder diameter of the engine, it is anticipated that injected fuel night reach a cylinder wail surface. Split injection is proposed as a method of preventing the injected fuel from reaching the cylinder wall surface by splitting fuel mass per a one-time injection stroke into several injections.

As regards split injection, the related art of JP 2002-115591A discloses a driving method of the movable core only before the valve plug sits on the valve seat, but does not give special consideration to behaviors of the valve plug and its movable core after the valve plug sat on the valve seat with impact. After the valve plug sat on the valve seat, the valve plug and its movable core continue with their rebound motion on impact on the valve seat.

In particular, regarding in an injection fuel valve having a configuration that permits the movable core to have a relative motion with respect to the valve plug, the movable core continuously has the relative motion with respect to the valve plug after the valve plug sat on the valve seat with impact. Therefore, it takes some time for the movable core to come to rest, so it is necessary to allow a sufficient time interval between one injection and the next. Further, after the valve plug sat on the valve seat with impact, the movable core has the following behavior. That is, first of all, the movable core has a motion independent of the valve plug for a brief moment because of having a relative motion with respect to the valve plug to absorb the impact between the valve plug and the valve seat. Subsequently after a lapse of predetermined time, the movable core engages the valve plug again by working of a spring in a valve opening direction. However, at this moment, provided that a mass of the movable core and/or an impact speed of the valve plug are excessive, the movable core pushes up the valve plug, and thereby the valve plug may leave from the valve seat in spite of the valve closing operation.

As a method of reducing a time interval of the split injection, for example, JP 2008-230876A discloses of reducing the rest time of the valve plug by supplying an intermediate current just after the valve plug sat on the valve seat.

However, the above-mentioned prior arts don't give special consideration to timing of intermediate current supply and timing of intermediate current supply shut-off.

The present invention has been made in view of the above circumstances, and its object is to provide a drive device for a fuel injection valve capable of reducing a time interval between a first fuel injection period and a second fuel injection period subsequent to the first fuel injection period.

SUMMARY OF THE INVENTION

The drive device for an fuel injection valve of the present invention is configured to, during a time interval between an earlier fuel injection (first fuel injection) and a later fuel injection (second fuel injection), supply an electromagnetic coil with an intermediate current at a voltage with a level of not opening the valve. Further, the drive device sets a voltage application for supplying the intermediate current to initiate before a valve closing in the earlier fuel injection and terminate before half a period of time between a first instant when the valve is closed in the earlier fuel injection and a second instant when a supply of a drive current for opening the valve is initiated in the rater fuel injection.

More specifically, proposed is the following configuration.

(1) According to a first aspect of the present invention, provided is the following drive device.

The drive device for a fuel injection valve having an electromagnet with a stationary core and an electromagnetic coil, a movable core driven with the electromagnet, a valve plug assembled into the movable core, a pressure member of giving the movable core a pressure in a valve closing direction, and the drive device of controlling a voltage applied in accordance with a fuel injection pulse to supply the electromagnetic coil with a current, wherein the drive device is configured to, in between termination of an electromagnetic coil-voltage application equivalent to termination of a first fuel injection period and initiation of an electromagnetic coil-voltage application equivalent to initiation of a second fuel injection period subsequent to the first fuel injection period, apply the electromagnetic coil with a voltage at a level of not opening the valve to supply an intermediate current for the electromagnetic coil in the same direction as a direction of a drive current for opening the valve, and the drive device sets the voltage application for the intermediate current to initiate after turning off the electromagnetic coil-voltage application in the first fuel injection period before a first point in time when the valve plug sits on a valve seat and terminate before half a period of time between the first point in time and a second point in time when initiating an application of a drive voltage for opening the valve in the second fuel injection period.

(2) According to a second aspect of the present invention, in addition to the above-mentioned features (1), the drive device may be configured to set a split injection of splitting fuel mass per a one-time injection stroke into several times which, and which are the first fuel injection period and the second fuel injection period. Here, the one-time injection stroke is equivalent to from an intake stroke (which may overlap partly with a last exhaust stroke depending on the case) to a compression stroke per a one-time combustion stroke.

(3) According to a third aspect of the present invention, in addition to the above-mentioned aspect (2), the drive device may include a booster circuit that boosts a voltage supplied from a power source to a higher voltage than that of the power source, and the voltage application for the intermediate current is generated with the voltage booster circuit.

(4) According to a fourth aspect of the present invention, in addition to the above-mentioned aspect (3), the drive device may be configured to terminate the voltage for the intermediate current before a magnitude of the intermediate current reaches a magnitude required for a magnetic force separating the valve plug having sat on the valve seat from the valve seat.

(5) According to a fifth aspect of the present invention, in addition to the above-mentioned aspect (4), the drive device may set such that each of the first fuel injection period and the second fuel injection period includes two kinds of voltage application periods, one of which is a boosted voltage application period of applying the electromagnetic coil with a boosted voltage equivalent to a drive voltage for a valve open, the other of which is a power source-voltage application period of applying the electromagnetic coil with a voltage of the power source for holding the valve-open by means of switching subsequent to the boosted voltage application period, wherein a maximum value of the intermediate current is set to be greater than a maximum value of a current supplied to the electromagnetic coil by the voltage of the power source in the power source-voltage application period, and set to be smaller than a maximum value of a current supplied to the electromagnetic coil by the boosted voltage in the boosted voltage application period.

(6) According to a sixth aspect of the present invention, in addition to the above-mentioned aspect (1), the drive device may be configured to generate a voltage application for supplying the intermediate current by controlling a pulse width of an injection pulse output from an engine control unit.

(7) According to a seventh aspect of the present invention, in addition to any one of the above-mentioned aspects (1) to (6), wherein the fuel injection valve to which the drive device applied is, comprises the movable core having a relative motion with respect to the valve plug to absorb the impact between the valve plug and the valve seat, and a pressure member applying the movable core with a force in a valve opening direction; and wherein timing of terminating the voltage application is obtained by dividing the product of a velocity of impact between the valve plug and the valve seat and a mass of the movable core by the force of the pressure member.

(8) According to an eighth aspect of the present invention, provided is the following drive device.

The drive device for a fuel injection valve having an electromagnet with a stationary core and an electromagnetic coil, a movable core driven with the electromagnet, a valve plug assembled into the movable core, a pressure member of giving the movable core a pressure in a valve closing direction, and the drive device of controlling a voltage applied in accordance with a fuel injection pulse to supply the electromagnetic coil with a current, wherein the drive device is configured to, in between termination of an electromagnetic coil-passage of current equivalent to termination of a first fuel injection period and initiation of an electromagnetic coil-passage of current equivalent to initiation of a second fuel injection period subsequent to the first fuel injection period, supply the electromagnetic coil with an intermediate current for in the same direction as a direction of a drive current for opening the valve, and the drive device sets the intermediate current to initiate after turning off the electromagnetic coil-passage of current in the first fuel injection period before a first point in time when the valve plug sits on a valve seat and terminate before half a period of time between the first point in time and a second point in time when initiating an electromagnetic coil-passage of current in the second fuel injection period.

According to an embodiment of the present invention, it is possible to shorten an interval between the first fuel injection period and the second fuel injection period subsequent to the first fuel injection period. In addition, when this technology is applied to split injection, a fuel injection valve can be driven while the split injection is performed at reduced intervals.

DETAILED DESCRIPTION OF THE PREFERRED EMBODIMENTS

Figure 2:
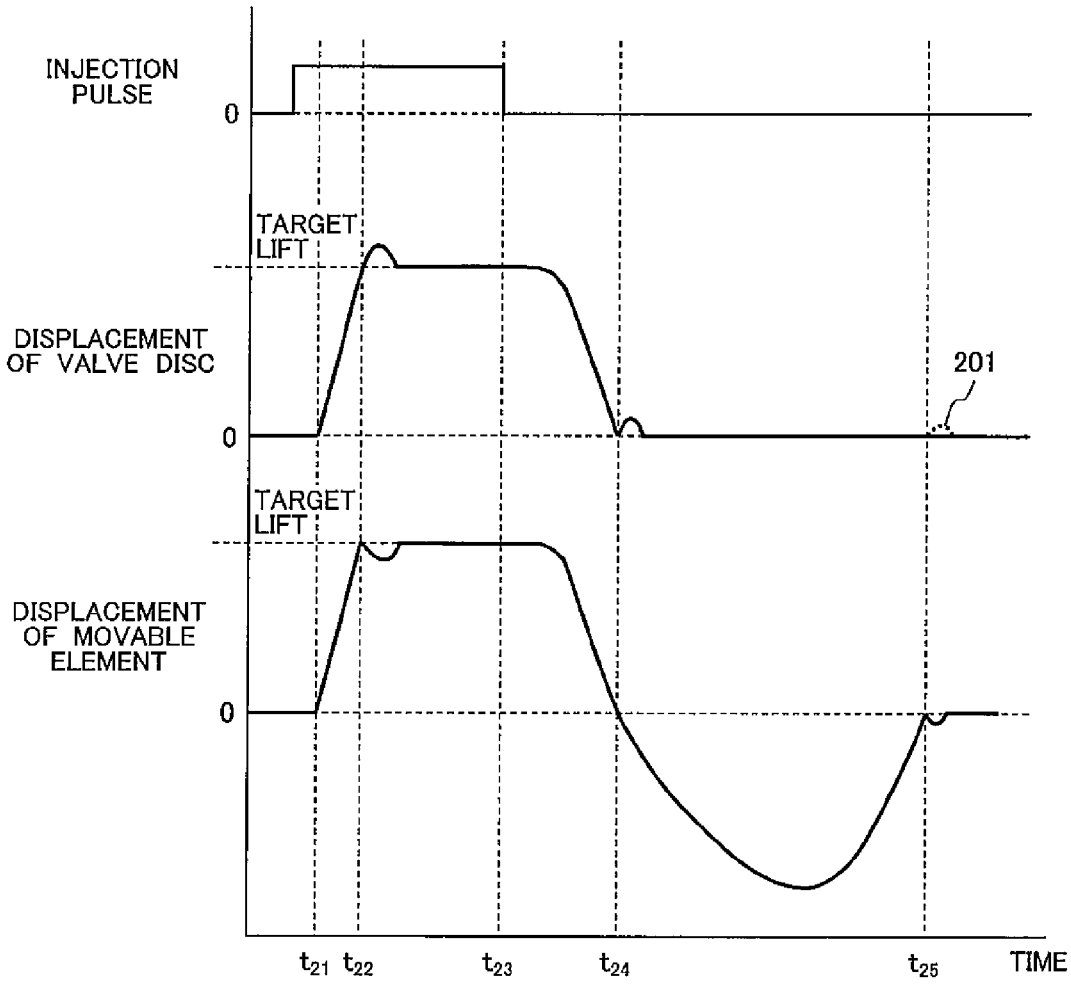
FIG. 2 is a diagram illustrating a relationship between a common injection pulse for driving the fuel injection valve, a behavior of a valve plug, and a behavior of a movable core.
Figure 3:
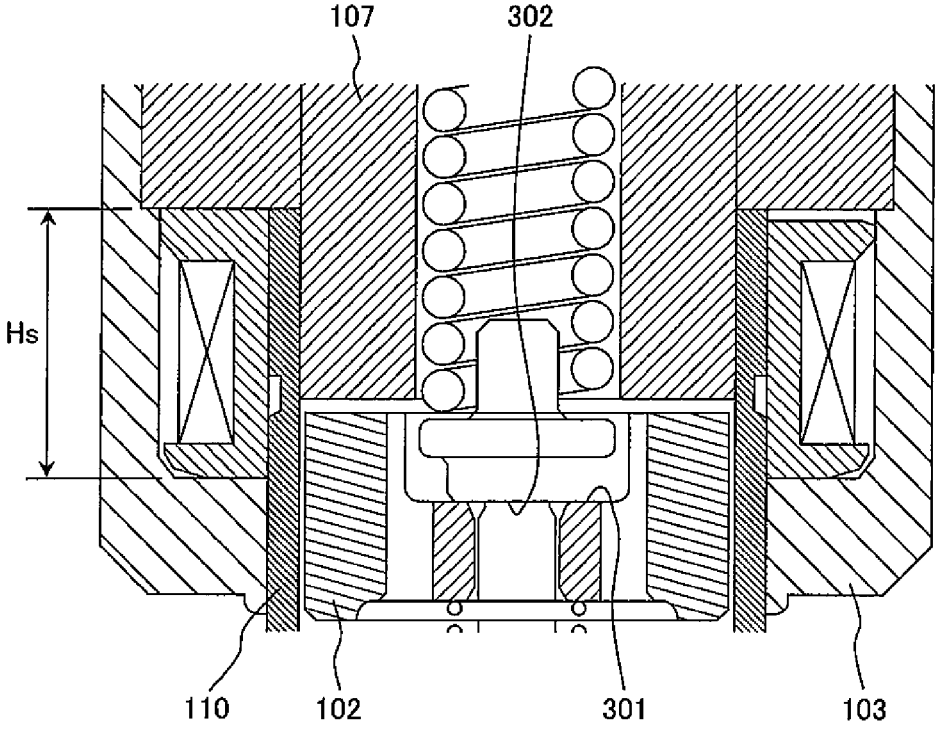
FIG. 3 is an enlarged cross-sectional view illustrating the vicinity of an impact portion between the movable core and the valve plug of the fuel injection valve shown in FIG. 1.

A configuration and an operation of a fuel injection device according to an embodiment of the present invention will now be described with reference to FIGS. 1 to 3.

First of all, the configuration and basic operation of the fuel injection device according to the embodiment of the present invention will be described with reference to FIG. 1. FIG. 1 represents a configuration of the fuel injection device including a fuel injection valve with a vertical cross-sectional view, an EDU (drive circuit unit) 121 and an ECU (engine control unit) 120 for driving and controlling the fuel injection valve. The ECU 120 and the EDU 121 may be integrated into a single part. A drive device for the fuel injection valve (electromagnetic fuel injection valve) is at least a device for generating a drive voltage for the fuel injection valve, and may be an integrated combination of the ECU and EDU or formed by the EDU alone.

The ECU 120 receives signals indicative of an engine status from various sensors and determines an appropriate injection pulse width and injection timing in accordance with operating conditions for an internal combustion engine. An injection pulse output from the ECU 120 is received with the EDU 121 of the fuel injection valve through a signal line 123. The EDU 121 controls a voltage to be applied to an electromagnetic coil 105, and supplies a current. The ECU 120 communicates with the EDU 121 through a communication line 122 and can change over a drive current which is generated by the EDU 121, in accordance with the operating conditions and the pressure of fuel to be supplied to the fuel injection valve. The EDU 121 can change a control constant by communicating with the ECU 120, so a current waveform to be supplied to the electromagnetic coil can be changed with the control constant. When split injection is performed in accordance with the embodiment of the present invention, a split injection control is executed either by allowing the ECU 120 to output a voltage application command pulse for supplying an intermediate current for split injection or by having the ECU 120 transmit the control constant to the EDU 121 to let the EDU 121 directly supply the intermediate current.

The configuration and operation of the fuel injection device will now be described with reference to FIG. 1 and FIG. 2 namely, referring to the vertical cross-sectional view of the fuel injection valve illustrated in FIG. 1, and referring to a relationship between an injection pulse and displacements of a valve plug 114 and a movable core 102 illustrated in FIG. 2. FIG. 2 represents the relationship between the injection pulse output from the ECU, a behavior of the valve plug 114, and a behavior of the movable core 102.

Figure 1:
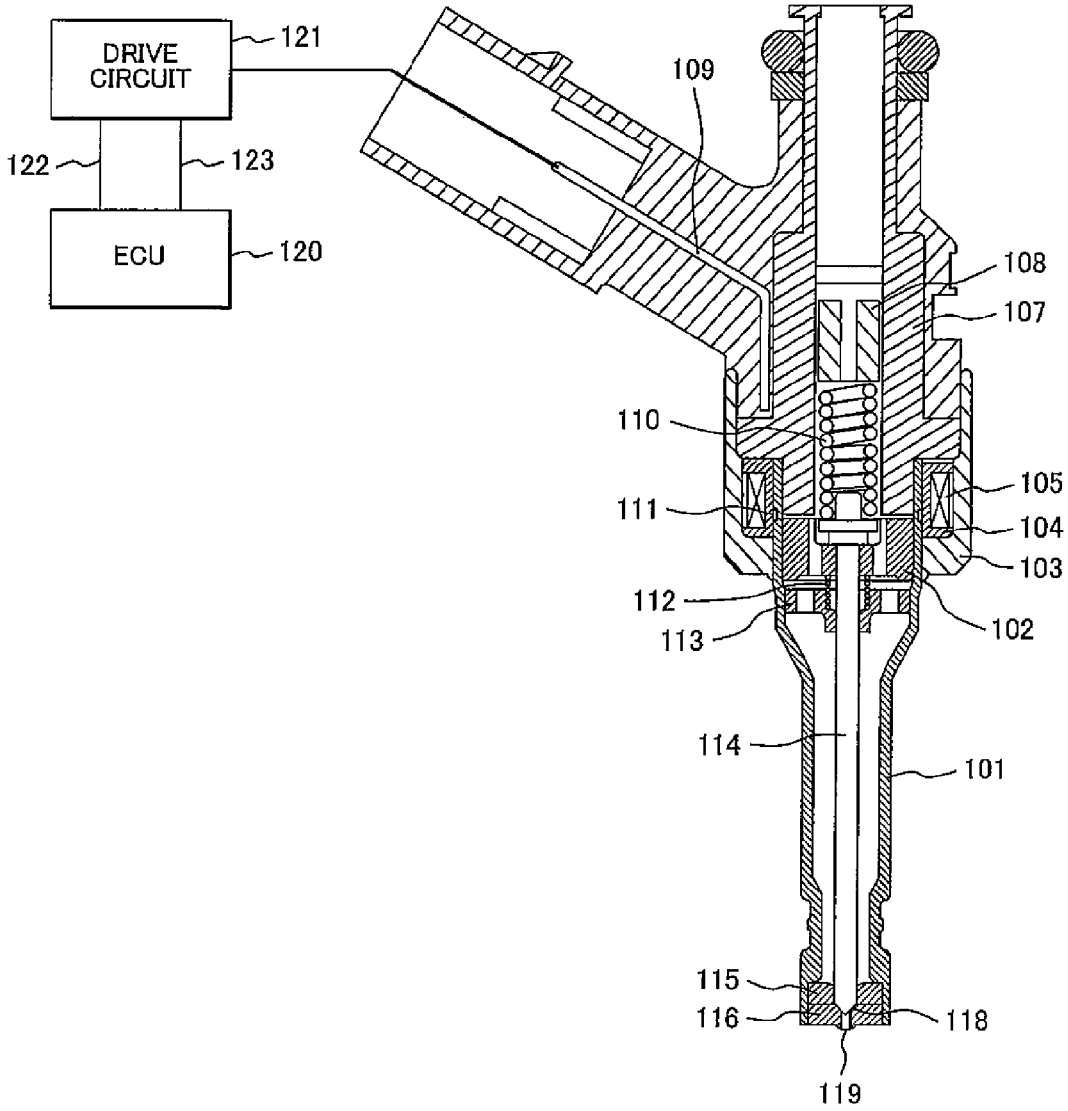
FIG. 1 is a vertical cross-sectional view illustrating a fuel injection valve according to an embodiment of the present invention.

The fuel injection device shown in FIG. 1 is a normally-closed electromagnetic fuel injection valve. Upon the electromagnetic coil 105 being non-energized, the valve plug 114 is pressed in a valve closing direction by a spring (first spring) 110 so as to sit on a valve seat 118 resulting in a valve closing. In this valve closed state, the movable core (which may be referred to as an anchor or a movable element) 102 is pressed in a valve opening direction by a zero spring (second spring) 112 such that an engagement portion 301 of the movable core 102 is in contact with an engagement portion 302 (refer to FIG. 3) of the valve plug 114 having an engagement to each other. In this state, there is a gap between the movable core 102 and a magnetic core (which may be referred to as the stationary core) 107. Fuel is supplied from the top of the fuel injection valve and sealed, by a valve seat 118. Upon the valve being closed, fuel pressure is applied to the valve plug 114, so that the valve plug 114 is pressed against the valve seat 118 in the valve closing direction by a force depending on a seat inside diameter at a valve seat position.

The fuel injection valve has a magnetic circuit being constituted by the magnetic core 107, the movable core 102, and a yoke 103. When the injection pulse is applied to the electromagnetic coil, an excitation current flows through the electromagnetic coil 105, thereby a magnetic flux is generated in the magnetic circuit. A magnetic attractive force is then generated between the magnetic core 107 and the movable core 102. At timing $t_{21}$ at which the magnetic attractive force exerted on the movable core 102 exceeds the sum of a load applied by the spring 110 and a force exerted by the fuel pressure, the movable core 102 moves upward (toward the magnetic core 107). Upon such a displacement of the movable core 102, the engagement portion 301 of the movable core 102 comes into contact (engages) with the engagement portion 302 of the valve plug 114, so a force transmission occurs between the engagement portion 301 and the engagement portion 302. In this instance, the movable core 102 and the valve ping 114 engages with each other and move together upward (toward the magnetic core 107). An upper end face of the movable core 102 then impacts on the lower surface of the magnetic core 107 resulting in the valve opening.

As a result, the valve plug 114 leaves from the valve seat 118, so the fuel supplied into the fuel injection valve is injected from a plurality of injection holes 119 provided to an orifice plate 116.

Subsequently, when the injection pulse turns off at timing $t_{23}$, the current applied the electromagnetic coil 105 shuts off, so the magnetic flux generated in the magnetic circuit disappears and the magnetic attractive force is put out.

In addition to that, the load, by the spring 110 and the force by the fuel pressure since are applied to the movable core 102, the valve plug 114 sits on the valve seat 118 (comes into contact with the valve seat 118) thereby to close the injection holes 119. At this time, the force applied to the valve plug 114 by the spring 110 is transmitted to the movable core 102 through the engagement portion 302 of the valve plug 114 and the engagement portion 301 of the movable core 102. As soon as the valve plug 114 sits on the valve seat 118 at timing $t_{24}$, with an inertial force of the movable core 102, the movable core 102 moves downward (in the valve closing direction) continuously independent from the valve plug 14 while compressing a zero spring 112 for engagement between engagement portions 301 and 302 (the zero spring 112 although works in the valve opening direction, its force is smaller than that of the spring 110 working in the valve closing direction). At this moment, the engagement portion 301 of the movable core 102 leaves from the engagement portion 302 of the valve plug 114. Subsequently, the movable core 102 is pushed back by the zero spring 112 such that the engagement portion 301 comes into contact with (engaged with) the engagement portion 302 of the valve plug 114 at timing $t_{25}$. At this point of time, it an upward force exerted on the movable core 102 (a force exerted in the valve opening direction) becomes greater than a downward force exerted on the valve plug 114 due to a reaction of the compressed zero spring 112 and an upward inertial force of the movable core 102, the valve plug 114 may be pushed upward as indicated at 201 (refer to FIG. 2). As a result, in spite of the valve closing mode, there is occurred a little time-valve open state resulting in an extra injection. As described above, the movable core 102 continues to move downward just after the valve plug 114 sat on the valve seat 118. Therefore, if the next split injection is performed before the movable core 102 comes to rest, the amount of injection unexpectedly varies with the position and speed of the movable valve element. To provide split injection at reduced intervals, therefore, it is necessary to ensure that the movable core 102 quickly comes to rest just after the valve sat on the valve seat 118 at the valve closing mode. To reduce such an extra injection, it is necessary to decrease the amount of kinetic energy generated when the movable core 102 impacts on the valve plug 114.

First Embodiment

Figure 4:
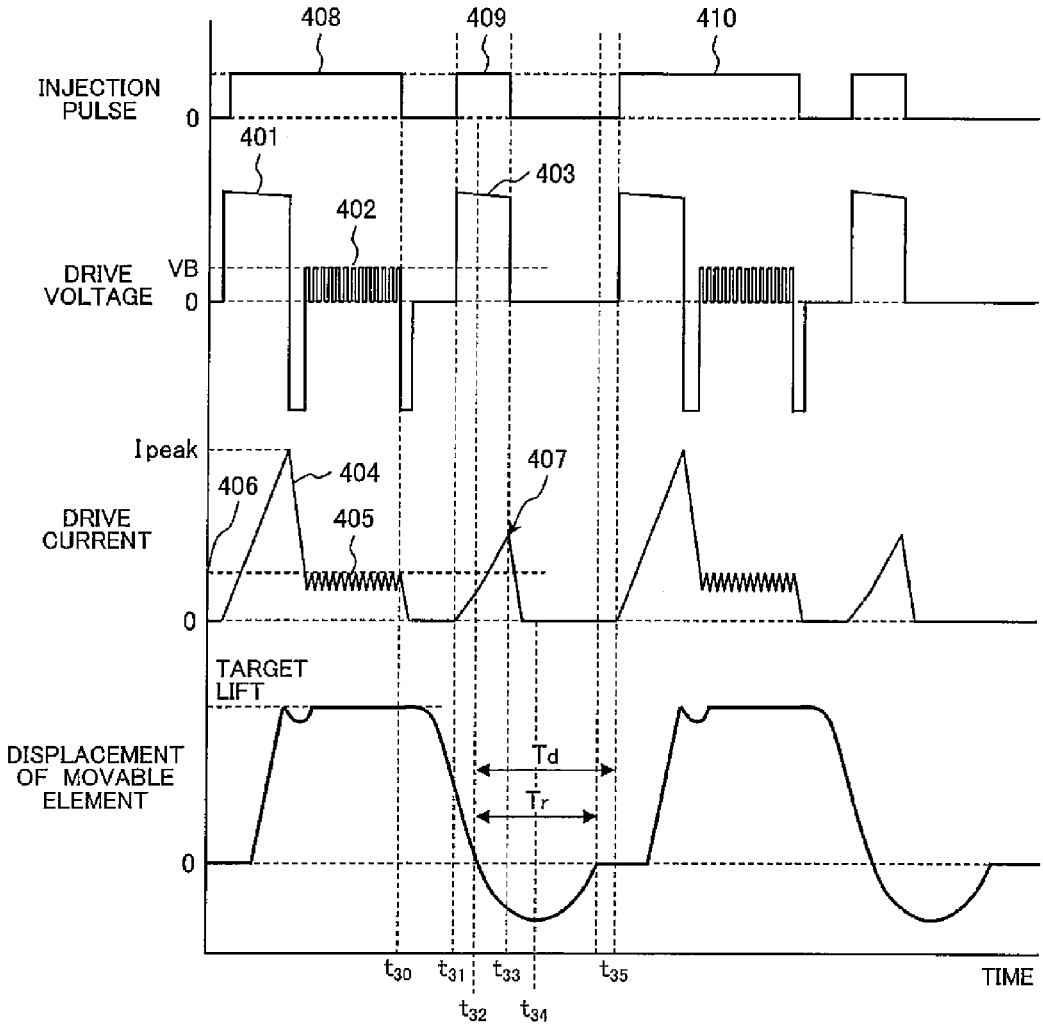
FIG. 4 is a diagram illustrating a relationship between an injection pulse output from an ECU according to a first embodiment of the present invention, timing of a voltage supply to the fuel injection valve, timing of an excitation current supply to the fuel injection valve, and a behavior of the movable core.

A first embodiment of the present invention will now be described with reference to FIG. 4. FIG. 4 is a diagram illustrating a relationship between the injection pulse output from the ECU 120, timing of a voltage supply to the fuel injection valve, timing of an excitation current supply to the fuel injection valve, and a behavior of the movable core 102. The embodiment examples a split injection of splitting fuel mass per a one-time injection stroke into several times such as in a first fuel, injection period (equivalent to a width of a first fuel injection pulse 408) and a second fuel injection period (equivalent to a width of a second fuel injection, pulse 410).

When an injection pulse 408 from the ECU 120 is received by the EDU 121, a high voltage 401 to be a drive voltage for the fuel injection valve is applied to the electromagnetic coil 105 from a high-voltage source of the EDU 121. Here the high voltage 401 is generated by boosting a battery voltage VB so as to be higher than the battery voltage VB. This makes the supply of a drive current 404 to the electromagnetic coil 105. Upon the value of the drive current 404 reaching a predetermined peak current value Ipeak, the application of the high voltage 401 is terminated to decrease the applied voltage to 0 V or lower and decrease a value of the drive current 404.

Subsequently, at a point of the time when a predetermined amount of time is elapsed or when the drive current is equal to or lower than a current value 406 capable of holding in the valve open state, the drive circuit 121 provides a battery voltage application 402 by means of switching and controls to obtain a predetermined valve current value 405 capable of holding in the valve open state. Subsequently, when the injection pulse 408 is turned off at $t_{30}$, the voltage to the electromagnetic coil is decreased to 0 V or lowers to reduce the excitation current. At a point of time when the sum of the load applied by the spring 110 and the force exerted by the fuel pressure in the valve closing direction exceeds a force exerted in the valve opening direction, the movable core 102 starts a valve closing sequence. Subsequently, before the displacement of the movable core 102 is reduced to 0 (zero) or less (namely, before the timing $t_{32}$ where the valve plug 114 sits on the valve seat 118, that is, before the timing when the engagement portion 301 of the movable core 102 is disengaged from the engagement portion 302 of the valve plug 114 to allow the movable core 102 to initiate its relative displacement in the valve closing direction with respect to the valve plug 114), an injection pulse 409 is turned on at $t_{31}$, and thereby causing the high-voltage source to apply a high voltage 403 and supplying an intermediate current 407 to the electromagnetic coil 105. Such an intermediate current has a level of not opening the valve and is supplied to the electromagnetic coil 105 for the following reason. That is, there is occurred, a magnetic time lag between the instant when the drive voltage 401 is applied to the electromagnetic coil 105 and the instant when the magnetic attractive force is generated between the magnetic core 107 and the movable core 102. Therefore, in view of such circumstances, provide that the intermediate voltage is applied before the displacement of the movable core 102 decreases to 0 (zero) or less (namely just before the valve plug sits on the valve seat), the motion of the movable core 102 can be quickly attenuated at timing $t_{32}$ and later (the timing $t_{32}$ is equivalent to a point in time when the valve plug 114 sits on the valve seat 118). This makes it possible to reduce the time Tr required for the movable core 102 to come to rest. Here, the timing $t_{31}$ of initiation of the immediate current 407 is set after turning off the electromagnetic coil-voltage application in the first fuel injection period (equivalent to the width of the fuel injection pulse 408) before a first point in time ($t_{32}$) when the valve plug 114 sits on the valve seat 118 (namely, the timing $t_{31}$ of initiation of the immediate current 407 is in between termination $t_{30}$ of the voltage application in the first fuel injection period and a point of time $t_{32}$ when the valve plug 115 sits on the valve seat 118; in other words, the timing $t_{31}$ of initiation of the immediate current 407 is in between termination of the first injection pulse 408 and a point of time when the valve plug 115 sits on the valve seat 118). As mentioned above, the intermediate current 407 is used to quickly attenuate the motion of the movable core 102 at timing $t_{32}$ and later. Regarding the timing $t_{31}$ of the intermediate current 407, it is preferable to set the timing $t_{31}$ as early as possible between a point of time $t_{30}$ and a point of time $t_{32}$, for example as illustrated in FIG. 4, set $t_{31}$ at a point, of time equal to or earlier than a point of time when a displacement of the valve reaches a half amount of an entire displacement thereof in the valve closing direction.

By setting of the timing $t_{31}$, the valve closing speed of the valve plug 114 can be decreased, effectively, so it possible to reduce not only a drive sound, which is emitted when the valve plug 114 sits on the valve seat 113 with impact, but also wear of the valve seat. In addition, as the speed of impact between the valve plug 114 and the valve seat 113 can be decreased, the time Tr required for the movable core 102 to come to rest can be further shortened.

Subsequently, the intermediate current is supplied for a predetermined period of time, and then the injection pulse 408 is turned off to shut off (terminate) the supply of the intermediate current 407 to the electromagnetic coil 105. The supply of the intermediate current 407 needs to terminate before the elapse of half a time period Td between the first point $t_{32}$ in time and a second point $t_{35}$ in time when initiating an application of a drive voltage for opening the valve in the second fuel injection period (equivalent to a width of the second injection pulse 410). The first, point 32 in time is a point in time when the displacement of the movable core 102 decreases to 0 (zero) or the valve plug 114 comes into contact with the valve seat 118. The second point $t_{35}$ in time is a point in time when the supply of the drive voltage is initiated for the second fuel injection subsequent to the first fuel injection in the split injection. By setting the above-mentioned timing of the termination of the supply of the intermediate current 407, it is possible to reduce extra injection because of preventing the movable core 102 from, accelerating again after timing $t_{34}$, and thereby reducing the impact of the valve plug for the valve seat resulting in suppression of pushing up the valve plug 114 in the valve closing operation.

In the present embodiment, the voltage application 403 for supplying the intermediate current 407 terminates before a magnitude of the intermediate current 407 increases as needed to separate the valve plug 114 on the valve seat 118 from the valve seat 118.

Further, each of the injection pulse 408 and the injection pulse 409 includes two kinds of voltage application periods, one of which is a boosted voltage application period of applying the electromagnetic coil 105 with a voltage (equivalent to the drive voltage 401 for a valve open) boosted by a boost circuit 514 (refer to FIG. 5), and the other of which is a power source-voltage application period of applying the electromagnetic coil 105 with a voltage 402 of a battery (power source for holding the valve-open) by means switching subsequent to the boosted voltage application period. Here, a maximum value of the intermediate current 407 is set to be greater than a maximum value of a current 405 supplied by the voltage 402 of the battery (power source) in the power source-voltage application period, and set to be smaller than a maximum value of a current 404 by the boosted voltage 401 in the boosted voltage application period.

In the split injection, the injection pulse 408 is a pulse for a first fuel injection period, and an injection pulse 410 is a pulse for a second fuel injection period. The injection pulse 409 is an injection pulse for the intermediate current being supplied in between the first fuel injection period and the second fuel injection period. However, the injection pulse 409 does not cause the valve plug 114 to perform a valve opening operation. Incidentally, at the point $t_{30}$ of time when the injection pulse 408 terminates in the first fuel injection period, the valve plug 114 has not completely returned to a valve closing position (namely has not sat on the valve seat yet), so a fuel injection itself terminates with a small delay after the termination of the injection pulse 408. This also holds true for the second fuel injection period.

The injection pulse 408 for the first fuel injection period and the injection pulse 410 for the second fuel injection period are output during a single injection stroke. In other words, the present embodiment is configured such that the fuel mass provided per one-time injection stroke is split into a plurality of injections, which are provided by at least the injection pulses 408 and 409. The term "one-time injection, stroke" denotes one combustion cycle (which includes an intake stroke, a compression stroke, an explosion stroke, and an exhaust stroke when a four-cycle engine is employed).

Figure 5:
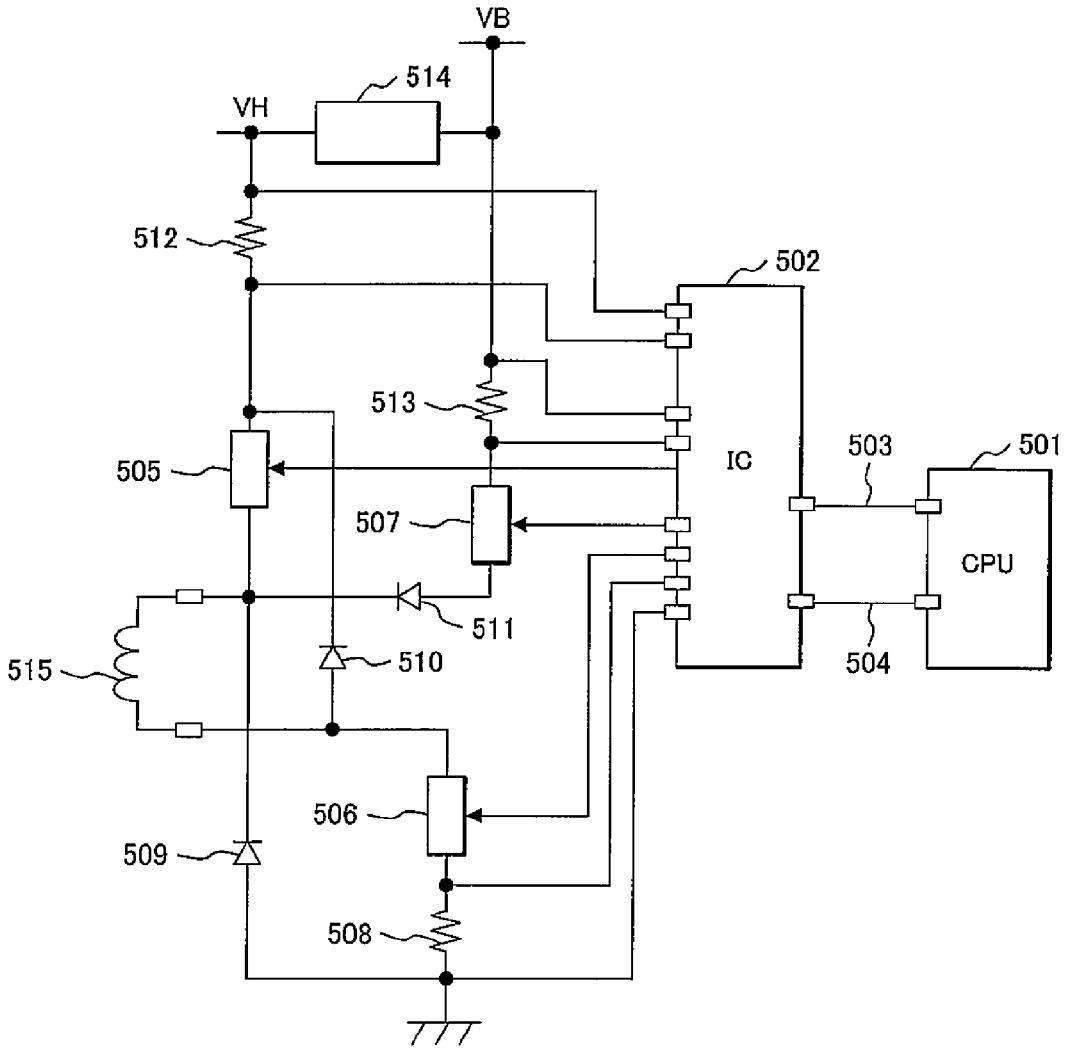
FIG. 5 is a diagram illustrating a configuration of a drive circuit for driving the fuel injection valve according to the embodiment of the present invention.

The configuration of the drive circuit 121 of the fuel injection valve according to the first embodiment of the present invention will now be described with reference to FIG. 5. FIG. 5 is a diagram illustrating the circuit configuration for driving the fuel injection valve. A CPU 501, which is included, for instance, in the ECU 120, computes an appropriate injection pulse width Ti and injection timing in accordance with the operating conditions for the internal combustion engine and outputs an injection pulse Ti to a drive IC 502 of the fuel injection valve through a communication line 504. Subsequently, the drive IC 502 selectively turns on or off switching elements 505, 506, 507 to supply the drive current to the fuel injection valve 515.

The switching element 505 is connected between a high-voltage source VH, which outputs a higher voltage than a voltage source VB whose voltage is input into the drive circuit 121, and a high-voltage terminal of the fuel injection valve 515. The switching elements 505, 506, 507 include, for instance, an FET or other transistor. The high-voltage source VH outputs a voltage of 60 V. This voltage is generated by boosting the battery voltage with the booster circuit 514. The booster circuit 514 includes, for instance, a DC/DC converter. The switching element 507 is connected between, a low-voltage source VB and a high-voltage terminal of the fuel injection valve 515. The output of the low-voltage source VB is, for instance, a battery voltage of 12 V. The switching element 506 is connected between, a ground potential and a low-voltage terminal of the fuel injection valve 515. The drive IC 502 causes current detection resistors 508, 512, 513 to detect the value of a current flowing in the fuel injection valve 515 and selectively turns on or off the switching elements 505, 506, 507 in accordance with the detected current value to generate a desired drive current. Diodes 509, 510 are employed to shut off the supply of the current. The CPU 501 communicates with the drive IC 502 through a communication line 503 and can change the drive current, which is to be generated by the drive IC 502, in accordance with the operating conditions and the pressure of fuel to be supplied, to the fuel injection valve 515.

Figure 6:
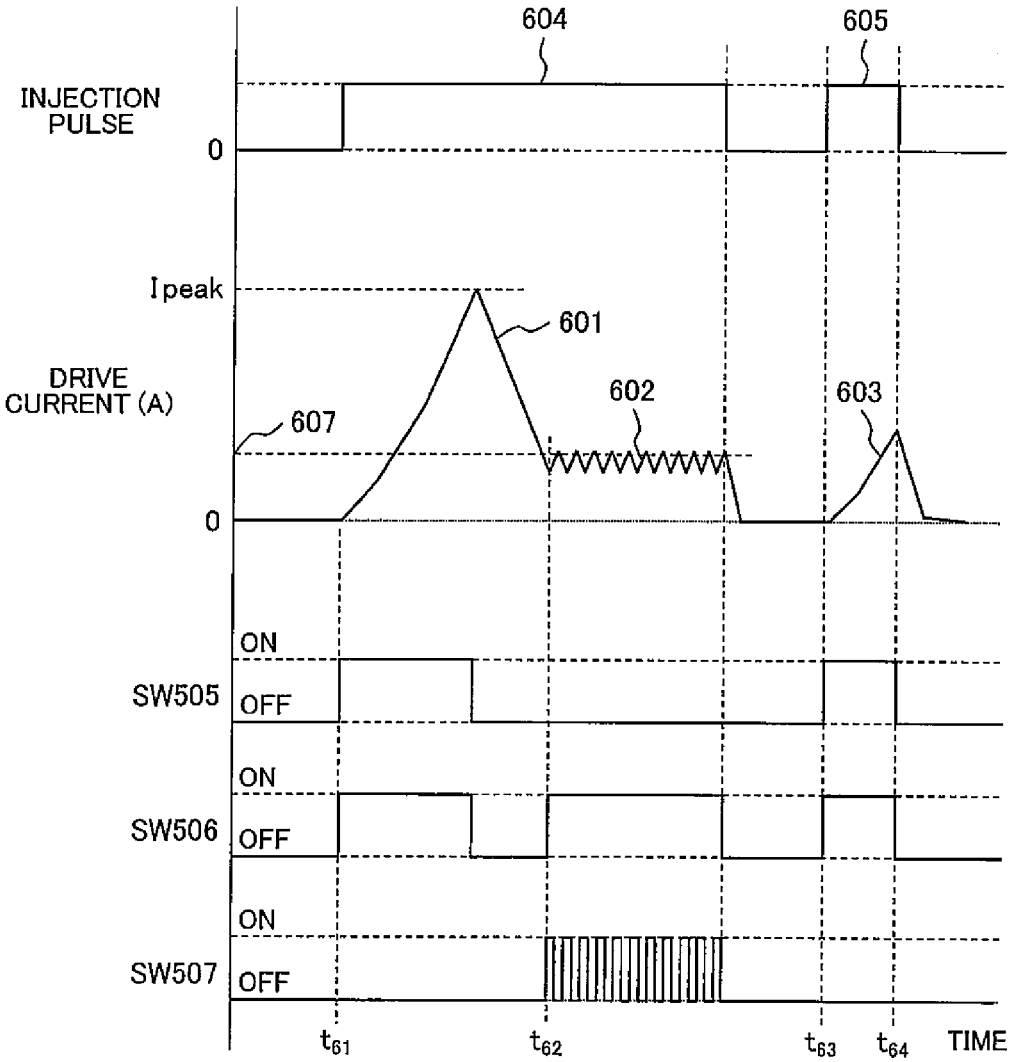
FIG. 6 is a diagram illustrating a relationship between an injection pulse output from an ECU in the drive circuit for driving the fuel injection valve according to the embodiment of the present invention, timing of an excitation current, and switching timing of a switching element.

Next, described will now be executed with reference to FIGS. 5 and 6 as to the timing of switching carried out by the switching element for generating the drive current that flows in the fuel injection valve according to the first embodiment of the present invention.

FIG. 6 is a diagram illustrating the injection pulse output from the CPU 501, the drive current, and timings of the switching element (SW) 505, the switching element (SW) 506, and the switching element (SW) 507.

When, at timing $t_{61}$, an injection pulse Ti 604 from the CPU 501 is received by the drive IC 502 through the communication line 504, the switching elements 505 and 506 are turned on. Thereby, a drive current with a higher voltage than the battery voltage is supplied from, the high-voltage source VH to the fuel injection valve 515, so the current builds up quickly. Upon the current reaching the peak current value Ipeak, the switching elements 505, 506 both are turned off, so a counter-electromotive force is generated based on an inductance of the fuel injection valve 515. And then the diodes 509 and 510 are conducted by the counter-electromotive force, the current is fed back to the high-voltage source VH. The current supplied to the fuel injection valve 515 then quickly decreases from the peak current value Ipeak as indicated at 601 to a holding current 602. Upon the switching element 506 being turned on during a period of transition from the peak current value Ipeak to the holding current 602, the current based on counter-electromotive force energy flows toward the ground potential and gradually decreases. Subsequently, at timing $t_{62}$, the switching element 506 is turned on and the switching element 507 is controlled so as to repeatedly switch between ON and OFF, so retain the holding current 602 is retained as it is. Subsequently, the injection pulse 604 subsequently is turned off, the switching elements 506 and 507 both are turn off to decrease the current 602. After that, an injection pulse 605 is generated after the elapse of a predetermined period of time, the switching elements 505, 506 both is turned on, so the high-voltage source VH supplies an intermediate current 603 to the fuel injection valve 515. Subsequently, the intermediate current 603 is supplied to the electromagnetic coil for a predetermined period in time, and then, upon an injection pulse-width in which the injection pulse is turned off at predetermined timing $t_{64}$, the switching elements 505 and 506 both are turned off to quickly decrease the intermediate current 603.

Second Embodiment

Figure 7:
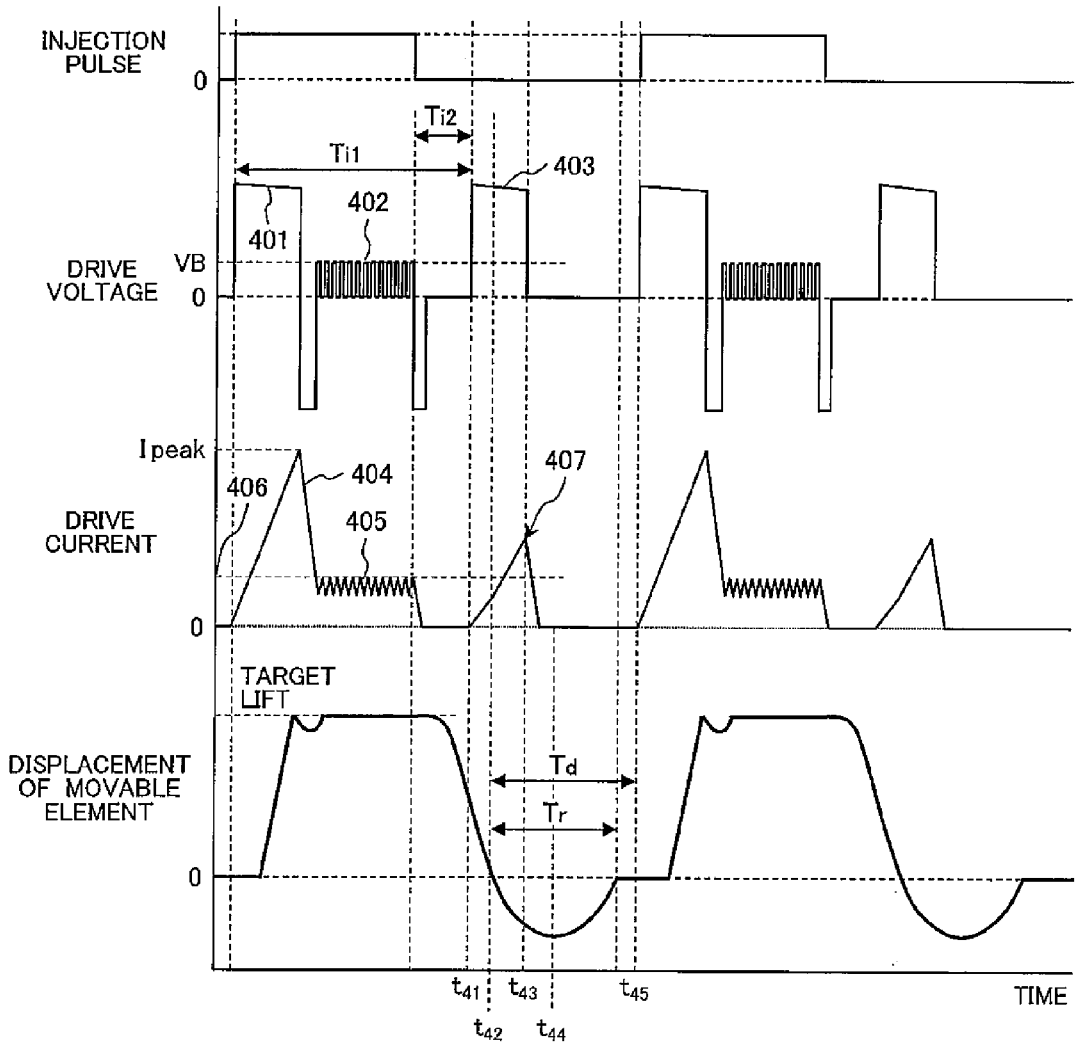
FIG. 7 is a diagram illustrating a relationship between an injection pulse output from an ECU according to a second embodiment of the present invention, timing of a voltage supply to a fuel injection valve, timing of an excitation current supply to the fuel injection valve, and a behavior of a movable core.

A second embodiment of the present invention will now be described with, reference to FIGS. 1 and 7. FIG. 7 is a diagram illustrating a relationship between the injection pulse output from the ECU 120, timing of the drive voltage supply to the fuel injection valve, timing of the drive current supply to the fuel injection valve, and a behavior of the movable core 102.

The second embodiment differs from the first embodiment in that the high voltage 403 for supplying the intermediate current 407 is applied by using the drive circuit 121 instead of the injection pulse width from the ECU 120. When the timing $t_{41}$ of applying the high voltage 403 is controlled in accordance with the elapsed time $T_{i1}$ from initiation of the injection pulse or with the elapsed time $T_{i2}$ from termination of the injection pulse, the same advantage is obtained as in the first embodiment in which the intermediate current 407 is controlled by the injection pulse.

Third Embodiment

Figure 8:
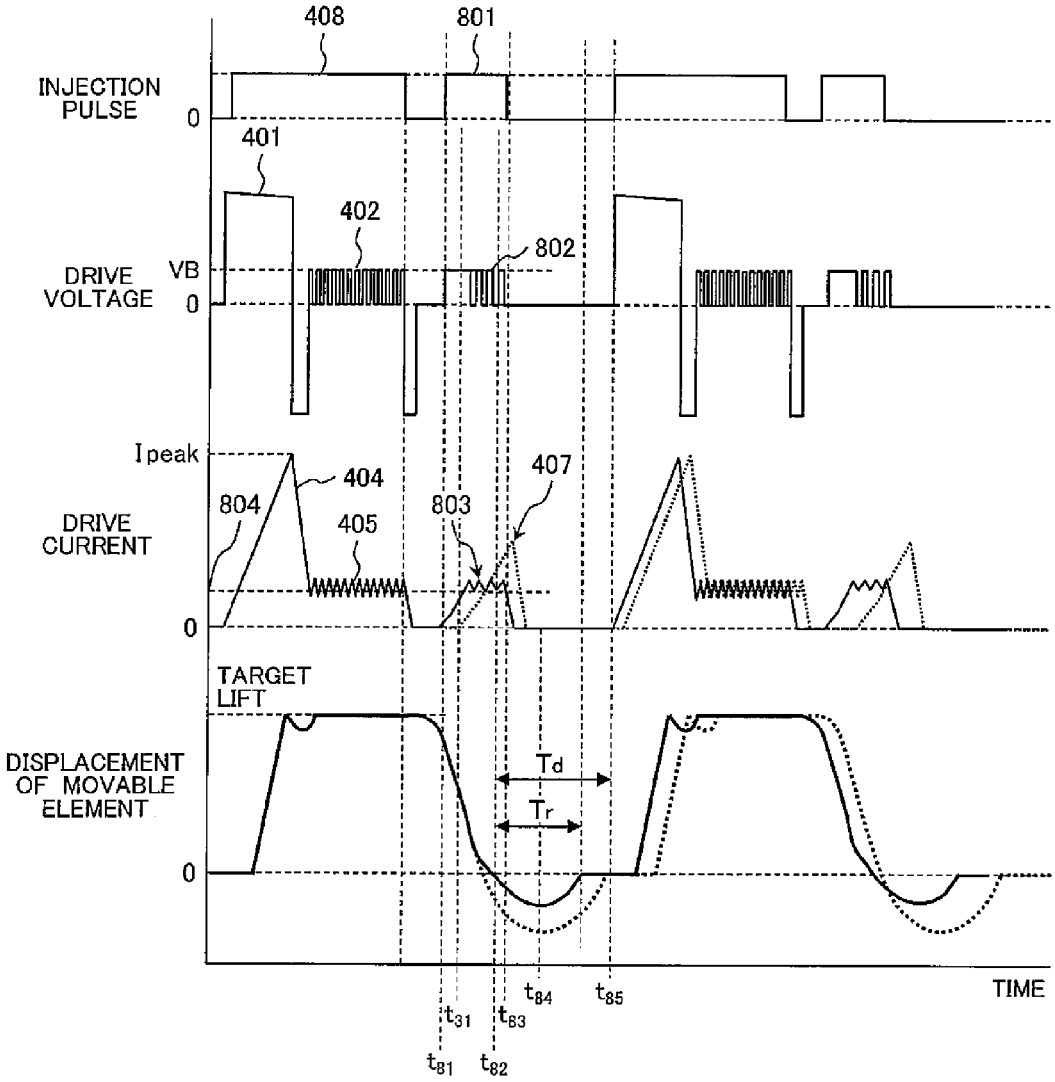
FIG. 8 is a diagram illustrating a relationship between an injection pulse output from an ECU according to a third embodiment of the present invention, timing of a voltage supply to a fuel injection valve, timing of an excitation current supply to the fuel injection valve, and a behavior of a movable core.

A third embodiment of the present invention will now be described with reference to FIGS. 1, 4, and 8. FIG. 8 is a diagram illustrating a relationship between the injection pulse output from the ECU 120 according to the third embodiment, timing of the drive voltage supply to the fuel injection valve, timing of the drive current (excitation current) supply to the fuel injection valve, and a behavior of the movable core 102. In FIG. 8, elements identical with those in FIG. 4 are designated by the same reference numerals as the corresponding elements. In FIG. 8, the drive current and the displacement of the movable core that are represented in FIG. 4 are indicated by dotted lines to clarify the differences from the first embodiment.

As indicated by the example illustrated in FIG. 8, the third embodiment differs from the first embodiment in that the injection pulse 801 is turned on at a timing earlier than the current resupply timing $t_{31}$ illustrated in FIG. 4 to apply the battery voltage VB from the voltage source and supply the intermediate current 803 to she electromagnetic coil 105. According to this feature, the magnetic attractive force can be generated again during an interval between the instant when the injection pulse 801 is turned, off and the instant when the magnetic flux in the magnetic circuit completely disappears. This makes it possible to reduce the magnetic time lag between the instant when the intermediate current 803 is supplied and the instant when the magnetic attractive force is generated. Further, as the impact speed between the valve plug 114 and the valve seat 118 can be decreased, the kinetic energy of the movable core 102 after the valve-closing can be reduced. This makes it possible to reduce the time Tr required for the movable core 102 to come to rest. In addition, supplying the intermediate current 803 at a stage earlier than the timing $t_{31}$ decreases the valve closing speed of the valve plug 114. This reduces not only a drive noise being emitted when the valve plug 114 sits on the valve seat 118 with impact, but also wear of the valve seat.

Upon the intermediate current 803 reaching a predetermined current value after a point $t_{81}$ in time when the intermediate current 803 is supplied, the drive circuit 121 applies the battery voltage by means of switching as indicated at 802 and exercises control so as to obtain a predetermined current value 804. Upon the intermediate current 803 holding the predetermined current value 804 for a certain period, the magnetic attractive force generated between the stationary core 107 and the movable core 102 can be maintained constant. Thus, the time Tr required for the movable core 102 to come to rest can be accurately controlled. Further, as the power consumption of the drive circuit 121 is proportional to the square of the value of the current supplied to the electromagnetic coil 105, the consumption of current can be reduced when the supply of the intermediate current 803 is achieved by applying the battery voltage VB. Moreover, when the high-voltage source VH supplies a current to the electromagnetic coil 105 in a situation where the high-voltage source VH is configured to boost the battery voltage VB by storing electric charge into a capacitor, the voltage value of the high-voltage source VH decreases with time. When a voltage application from the high-voltage source VH is terminated, the voltage value of the high-voltage source is recovered to normal after a lapse of the predetermined time. However, if the high-voltage source VH applies a voltage before the voltage value of the high-voltage source VH is recovered to normal, the time required for current build-up may increase. In view of such circumstances, provided that the intermediate current 803 is supplied to the electromagnetic coil 105 by application of the battery voltage VB, the voltage value of the high-voltage source VH can be recovered to normal with ease at point $t_{85}$ when the drive voltage is supplied to perform the next split injection. As a result, the current can be steadily supplied to the electromagnetic coil 105.

What is claimed is:

1. A drive device for a fuel injection valve having an electromagnet with a stationary core and an electromagnetic coil, a movable core driven with the electromagnet, a valve plug assembled into the movable core, a pressure member of giving the movable core a pressure in a valve closing direction, the drive device comprising:

an engine control unit that is configured to determine a fuel injection pulse width and an injection timing; and a drive circuit unit that is configured to control a voltage to be applied to the electromagnetic coil and to supply a current to the electromagnetic coil, wherein the drive circuit unit controls the voltage to be applied to the electromagnetic coil in accordance with the fuel injection pulse width, the drive circuit unit is configured to, in between termination of an electromagnetic coil-voltage application equivalent to termination of a first fuel injection period and initiation of an electromagnetic coil-voltage application equivalent to initiation of a second fuel injection period subsequent to the first fuel injection period, apply the electromagnetic coil with a voltage at a level of not opening the valve to supply an intermediate current for the electromagnetic coil in the same direction as a direction of a drive current for opening the valve, and the drive circuit unit sets the voltage application for the intermediate current to initiate after turning off the electromagnetic coil-voltage application in the first fuel injection period before a first point in time when the valve plug sits on a valve seat and terminate before half a period of time between the first point in time and a second point in time when initiating an application of a drive voltage for opening the valve in the second fuel injection period.

2. The drive device according to claim 1, wherein the engine control unit is further configured to set a split injection of splitting fuel mass per a one-time injection stroke into several times which are the first fuel injection period and the second fuel injection period.

3. The drive device according to claim 2, further comprising a booster circuit that boosts a voltage supplied from a power source to a higher voltage than that of the power source, and the voltage application for the intermediate current is generated with the voltage booster circuit.

4. The drive device according to claim 3, wherein the drive circuit unit is further configured to terminate the voltage for the intermediate current before a magnitude of the intermediate current reaches a magnitude required for a magnetic force separating the valve plug having sat on the valve seat from the valve seat.

5. The drive device according to claim 4, wherein the engine control unit is further configured to set such that each of the first fuel injection period and the second fuel injection period includes two kinds of voltage application periods, one of which is a boosted voltage application period of applying the electromagnetic coil with a boosted voltage equivalent to a drive voltage for a valve open, the other of which is a power source-voltage application period of applying the electromagnetic coil with a voltage of the power source for holding the valve-open by means of switching subsequent to the boosted voltage application period, wherein a maximum value of the intermediate current is set to be greater than a maximum value of a current supplied to the electromagnetic coil by the voltage of the power source in the power source-voltage application period, and set to be smaller than a maximum value of a current supplied to the electromagnetic coil by the boosted voltage in the boosted voltage application period.

6. The drive device according to claim 1, wherein the drive circuit unit is further configured to generate a voltage application for supplying the intermediate current by controlling a pulse width of an injection pulse output from an engine control unit.

7. The drive device according to claim 1, wherein the fuel injection valve to which the drive device applied is, comprises the movable core having a relative motion with respect to the valve plug to absorb the impact between the valve plug and the valve seat, and a pressure member applying the movable core with a force in a valve opening direction; and wherein timing of terminating the voltage application is obtained by dividing the product of a velocity of impact between the valve plug and the valve seat and a mass of the movable core by the force of the pressure member.

8. A drive device for a fuel injection valve having an electromagnet with a stationary core and an electromagnetic coil, a movable core driven with the electromagnet, a valve plug assembled into the movable core, a pressure member of giving the movable core a pressure in a valve closing direction, the drive device comprising:

an engine control unit that is configured to determine a fuel injection pulse width and an injection timing; and a drive circuit unit that is configured to control a voltage to be applied to the electromagnetic coil and to supply a current to the electromagnetic coil, wherein the drive circuit unit controls the voltage to be applied to the electromagnetic coil in accordance with the fuel injection pulse width, the drive circuit unit is configured to, in between termination of an electromagnetic coil-passage of current equivalent to termination of a first fuel injection period and initiation of an electromagnetic coil-passage of current equivalent to initiation of a second fuel injection period subsequent to the first fuel injection period, supply the electromagnetic coil with an intermediate current for in the same direction as a direction of a drive current for opening the valve, and the drive circuit unit sets the intermediate current to initiate after turning off the electromagnetic coil-passage of current in the first fuel injection period before a first point in time when the valve plug sits on a valve seat and terminate before half a period of time between the first point in time and a second point in time when initiating an electromagnetic coil-passage of current in the second fuel injection period.

9. The drive device according to claim 2, wherein the fuel injection valve to which the drive device applied is, comprises the movable core having a relative motion with respect to the valve plug to absorb the impact between the valve plug and the valve seat, and a pressure member applying the movable core with a force in a valve opening direction; and wherein timing of terminating the voltage application is obtained by dividing the product of a velocity of impact between the valve plug and the valve seat and a mass of the movable core by the force of the pressure member.

10. The drive device according to claim 3, wherein the fuel injection valve to which the drive device applied is, comprises the movable core having a relative motion with respect to the valve plug to absorb the impact between the valve plug and the valve seat, and a pressure member applying the movable core with a force in a valve opening direction; and wherein timing of terminating the voltage application is obtained by dividing the product of a velocity of impact between the valve plug and the valve seat and a mass of the movable core by the force of the pressure member.

11. The drive device according to claim 4, wherein the fuel injection valve to which the drive device applied is, comprises the movable core having a relative motion with respect to the valve plug to absorb the impact between the valve plug and the valve seat, and a pressure member applying the movable core with a force in a valve opening direction; and wherein timing of terminating the voltage application is obtained by dividing the product of a velocity of impact between the valve plug and the valve seat and a mass of the movable core by the force of the pressure member.

12. The drive device according to claim 5, wherein the fuel injection valve to which the drive device applied is, comprises the movable core having a relative motion with respect to the valve plug to absorb the impact between the valve plug and the valve seat, and a pressure member applying the movable core with a force in a valve opening direction; and wherein timing of terminating the voltage application is obtained by dividing the product of a velocity of impact between the valve plug and the valve seat and a mass of the movable core by the force of the pressure member.

13. The drive device according to claim 6, wherein the fuel injection valve to which the drive device applied is, comprises the movable core having a relative motion with respect to the valve plug to absorb the impact between the valve plug and the valve seat, and a pressure member applying the movable core with a force in a valve opening direction; and wherein timing of terminating the voltage application is obtained by dividing the product of a velocity of impact between the valve plug and the valve seat and a mass of the movable core by the force of the pressure member.

14. A drive device for a fuel injection valve having an electromagnet with a stationary core and an electromagnetic coil, a movable core driven with the electromagnet, a valve plug assembled into the movable core, a pressure member of giving the movable core a pressure in a valve closing direction, the drive device comprising:

an engine control unit that is configured to determine a fuel injection pulse width and an injection timing; and a drive circuit unit that is configured to control a voltage to be applied to the electromagnetic coil and to supply a current to the electromagnetic coil, wherein the drive circuit unit controls the voltage to be applied to the electromagnetic coil in accordance with the fuel injection pulse width, the drive circuit unit is configured to, in between termination of an electromagnetic coil-voltage application equivalent to termination of a first fuel injection period and initiation of an electromagnetic coil-voltage application equivalent to initiation of a second fuel injection period subsequent to the first fuel injection period, apply the electromagnetic coil with a voltage at a level of not opening the valve to supply an intermediate current for the electromagnetic coil in the same direction as a direction of a drive current for opening the valve, the drive circuit unit sets the voltage application for the intermediate current to initiate after turning off the electromagnetic coil-voltage application in the first fuel injection period before a first point in time when the valve plug sits on a valve seat and terminate before half a period of time between the first point in time and a second point in time when initiating an application of a drive voltage for opening the valve in the second fuel injection period, the fuel injection valve to which the drive device applied is, comprises the movable core having a relative motion with respect to the valve plug to absorb the impact between the valve plug and the valve seat, and a pressure member applying the movable core with a force in a valve opening direction, and timing of terminating the voltage application is obtained by dividing the product of a velocity of impact between the valve plug and the valve seat and a mass of the movable core by the force of the pressure member.

15. The drive device according to claim 14, wherein the drive circuit unit is further configured to generate a voltage application for supplying the intermediate current by controlling a pulse width of an injection pulse output from an engine control unit.

16. The drive device according to claim 14, wherein the engine control unit is further configured to set a split injection of splitting fuel mass per a one-time injection stroke into several times which are the first fuel injection period and the second fuel injection period.

17. The drive device according to claim 16, further comprising a booster circuit that boosts a voltage supplied from a power source to a higher voltage than that of the power source, and the voltage application for the intermediate current is generated with the voltage booster circuit.

18. The drive device according to claim 17, wherein the drive circuit unit is further configured to terminate the voltage for the intermediate current before a magnitude of the intermediate current reaches a magnitude required for a magnetic force separating the valve plug having sat on the valve seat from the valve seat.

19. The drive device according to claim 18, wherein the engine control unit is further configured to set such that each of the first fuel injection period and the second fuel injection period includes two kinds of voltage application periods, one of which is a boosted voltage application period of applying the electromagnetic coil with a boosted voltage equivalent to a drive voltage for a valve open, the other of which is a power source-voltage application period of applying the electromagnetic coil with a voltage of the power source for holding the valve-open by means of switching subsequent to the boosted voltage application period, wherein a maximum value of the intermediate current is set to be greater than a maximum value of a current supplied to the electromagnetic coil by the voltage of the power source in the power source-voltage application period, and set to be smaller than a maximum value of a current supplied to the electromagnetic coil by the boosted voltage in the boosted voltage application period.

20. The drive device according to claim 16, wherein the fuel injection valve to which the drive device applied is, comprises the movable core having a relative motion with respect to the valve plug to absorb the impact between the valve plug and the valve seat, and a pressure member applying the movable core with a force in a valve opening direction, and timing of terminating the voltage application is obtained by dividing the product of a velocity of impact between the valve plug and the valve seat and a mass of the movable core by the force of the pressure member.

* * * * *